US006932127B2

(12) United States Patent
Samuelsen et al.

(10) Patent No.: US 6,932,127 B2
(45) Date of Patent: Aug. 23, 2005

(54) SYSTEM FOR TRANSFERRING OIL FROM AN OFFSHORE PLATFORM TO A TANKER

(75) Inventors: Arild K. Samuelsen, Tananger (NO); Trygve G. Egge, Hafrsfjord (NO)

(73) Assignee: Teekay Norway AS, Stavanger (NO)

( * ) Notice: Subject to any disclaimer, the term of this patent is extended or adjusted under 35 U.S.C. 154(b) by 0 days.

(21) Appl. No.: 10/478,571

(22) PCT Filed: Jun. 5, 2001

(86) PCT No.: PCT/NO01/00230

§ 371 (c)(1),
(2), (4) Date: Jun. 9, 2004

(87) PCT Pub. No.: WO02/098726

PCT Pub. Date: Dec. 12, 2002

(65) Prior Publication Data

US 2004/0211485 A1 Oct. 28, 2004

(51) Int. Cl.[7] ..... B65B 1/04
(52) U.S. Cl. ..... 141/387; 114/230.12; 441/4
(58) Field of Search ..... 141/387, 284, 141/230.12–230.14; 441/3–5

(56) References Cited

U.S. PATENT DOCUMENTS 4,867,211 A 9/1989 Dodge et al.
5,803,779 A * 9/1998 Horton, III ..... 441/4

FOREIGN PATENT DOCUMENTS

DE 302 6836 A1 2/1982
WO WO 00/02773 A1 1/2000

* cited by examiner

*Primary Examiner*—Steven O. Douglas
(74) *Attorney, Agent, or Firm*—Frommer Lawrence & Haug LLP; Ronald R. Santucci

(57) ABSTRACT

A system for transferring oil from an offshore tanker to a platform. The system comprises at least one flexible hose (4) which is adapted to direct transfer of oil from a supply means (7–10) on a deck (2) on the platform (1) to the tanker (58) in question, and a number of hose handling stations (3) which are distributed around the circumference of the platform deck (2). Each station (3) is provided with a coupling unit (15) which communicates with the supply means (7–10) and is arranged for connection or disconnection of an end (11) of the hose (4), and a handling means (18–22, 24, 25) for lowering or hoisting of the house end (11) to/from the surface (5) of the water around the platform (1).

12 Claims, 9 Drawing Sheets

SYSTEM FOR TRANSFERRING OIL FROM AN OFFSHORE PLATFORM TO A TANKER

This application is a 371 of International Patent Application No. PCT/NO01/00230 filed Jun. 5, 2001, now WO 02/098726 A1 published Dec. 12, 2002.

The invention relates to a system for transferring oil from an offshore tanker to platform. With offshore platform it is here meant both fixedly anchored, floating platforms and platforms standing on the seabed.

Offshore oil extraction takes place partly on great ocean depths (1000–2000 m). This entails that oil pipelines for the transfer of extracted oil to a land terminal become very expensive and difficult to lay, maintain and repair, with a large potential for environmental destructions if a leakage should arise.

On this background transport of oil with special tankers has become increasingly interesting as a transport means between oilfields and land terminals.

The systems of today are based on indirect unloading from production platforms, where the oil is transferred via pipes or floating hoses to a buoy which is fastened or anchored to the seabed, and to which the tanker is moored during the loading operation. As examples of known systems there may be mentioned Submerged Turret Loading (STL), Single Point Mooring (SPM), Single Anchor Loading (SAL), SAL-based tandem loading, or—if the production platform does not have an oil storage of its own—via floating storage vessels or FSUs (Floating Storage Units).

The object of the invention is to provide an oil unloading system enabling a secure and efficient transfer of oil directly between the production platform and a tanker, without the use of anchoring or moorings, and where the operation is independent of the prevailing wind direction and can be carried out at relatively large wave heights.

For achievement of the above-mentioned object there is provided a system of the introductorily stated type which, according to the invention, is characterised in that it comprises at least one flexible hose which is adapted to direct transfer of oil from a supply means on a deck on the platform to the tanker in question, and a number of hose handling stations which are distributed around the circumference of the platform deck, each station being provided with a coupling unit which communicates with the supply means and is arranged for connection or disconnection of an end of the hose, and a handling means for lowering or hoisting of the hose end to/from the surface of the water around the platform.

Dependent on the deck design of the platform, a sufficient number of hose handling stations are placed on the platform deck with a mutual distance enabling 360 degrees coverage of possible unloading positions, dependent on the prevailing wind direction. The hose handling stations preferably are identical and can be used to hang off the hose when this is not in use on the relevant station.

The system preferably comprises a means for repositioning of the hose on alternative hose handling stations, so that the hose is always accessible from the hose handling station having the most favourable location with respect to the prevailing weather and wind direction.

In alternative embodiments of the system the hose may be repositioned by the use of a tender, or by means of crane/winch equipment on the platform.

Connection and disconnection of a hose end on a hose handling station is carried out in a simple operation with a minimal consumption of resources and equipment. The operations and the equipment are based on the same outfit as that used for connection to the tanker. This gives an increased flexibility in the choice of unloading position on the platform deck, and a lesser degree of handling of the hose.

In the execution of an unloading operation one end of the hose is connected to the coupling unit on the hose handling station which, in the current situation, has the most favourable location with respect to the weather. After the second hose end has been lowered to the sea surface, the hose by means of lines and a tender is hauled over to and connected to a loading system on the tanker. The loading system may be a bow loading system having a bow manifold, or it may be a midship loading system having a midship manifold. During the entire loading operation the tanker is lying on dynamic positioning (DP), according to the weathervane principle and without the use of a mooring of any kind. Thus, the system presupposes assistance of a tender during the connecting procedure, and that the used tankers have a DP system of their own.

During the whole loading operation (about 15–20 hours) the tender will be in readiness as a tugboat if a total absence of machine power or a failure of the DP system should necessitate an emergency disconnection of the tanker. At the stem of the tanker there will be mounted an emergency towing system allowing a quick connection of a towing line between the tanker and the tender.

The system according to the invention entails a number of advantages which may be summarized as follows:

- does not require a buoy of its own
- does not require anchorage of any kind
- does not require mooring of the tanker
- does not require a floating hose between the tanker and a possible buoy
- always allows loading from the most favourable weather and wind direction
- allows a simple and efficient repositioning of the hose on the platform
- allows a simple and efficient connection and disconnection of the hose on the platform
- allows loading in sea conditions up to significant wave heights of 4,5 m The invention will be further described below in connection with exemplary embodiments with reference to the drawings, wherein FIG. 1 shows a schematic plan view of a platform which is provided with a system according to the invention;

Figure 13:
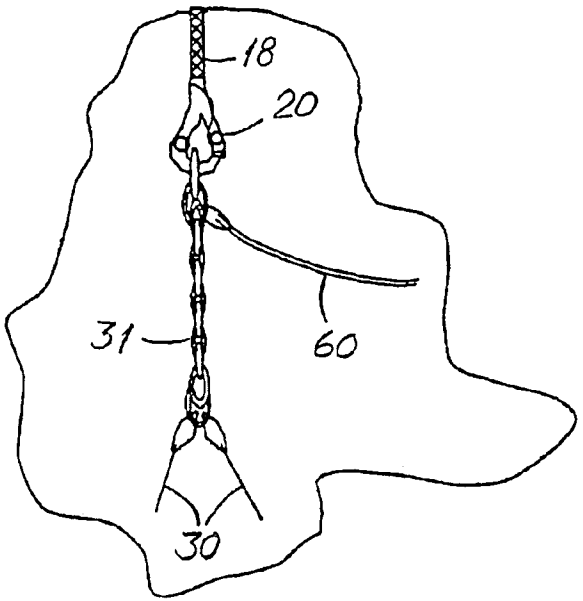
Figure 12:
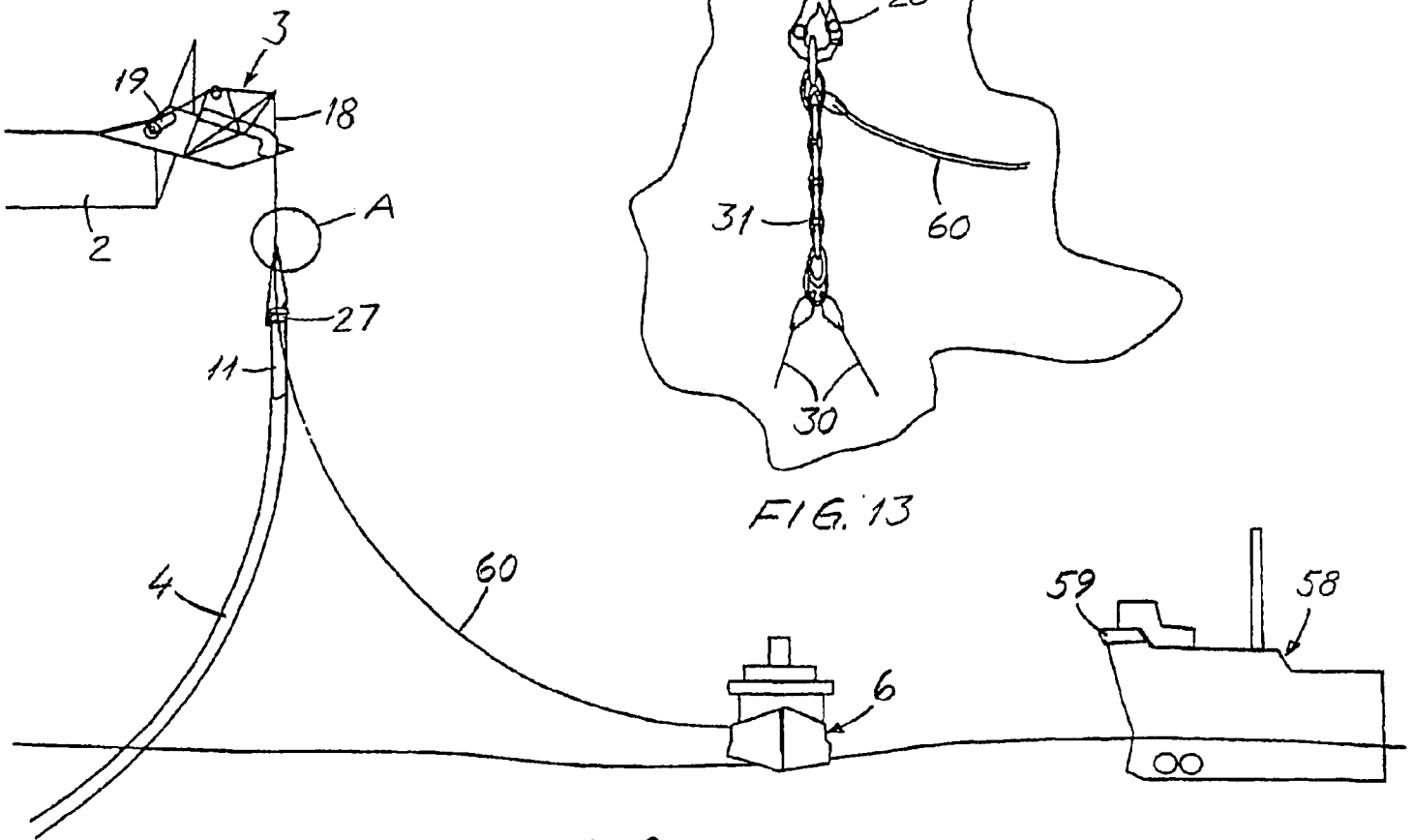
Figure 14:
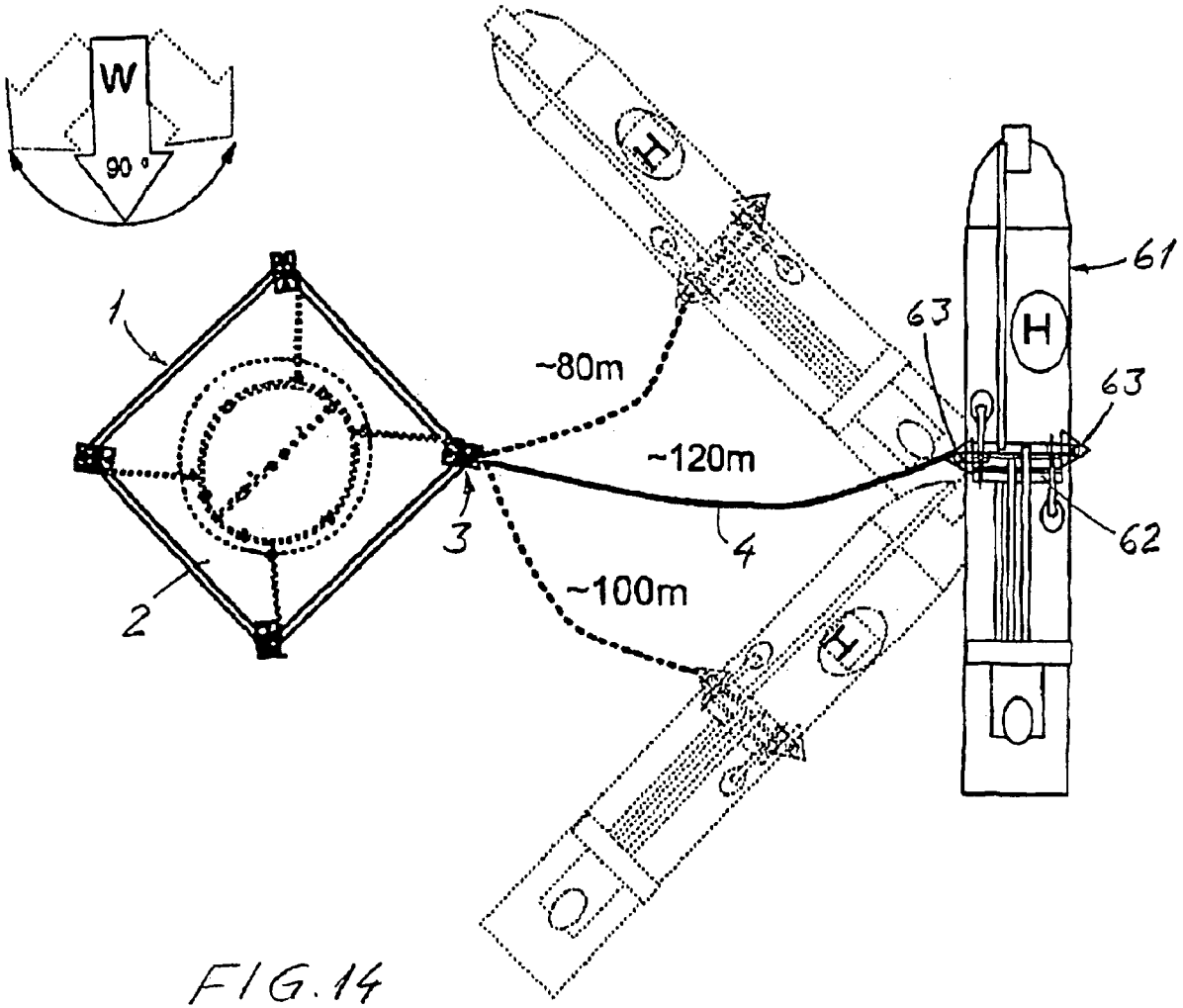
Figure 15:
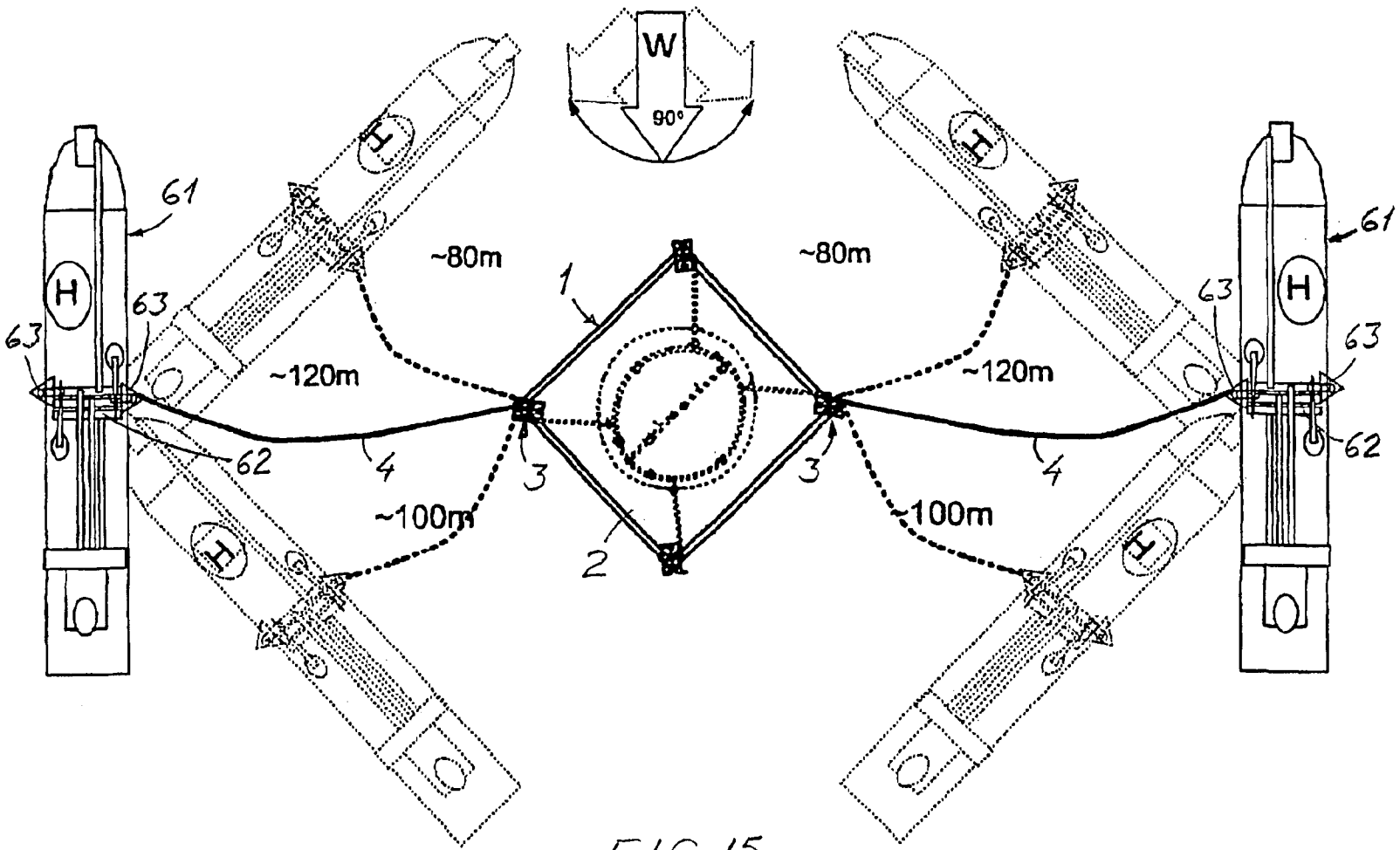

FIGS. 11A–D show different steps when transferring a hose end from a hose handling device to a pulling carriage in the cableway arrangement;

FIG. 12 is a general view showing a hose handling station on a platform deck, a tender and a partly shown tanker, where a hose is hanging from the station and to the upper end of the hose there is fixed a forerunner line which has been taken onboard the tender;

FIG. 13 shows the detail A in FIG. 12 on an enlarged scale;

FIG. 14 shows a plan view of a platform having a system according to the invention, with direct loading of a DP operated tanker which is provided with a midship manifold; and FIG. 15 shows a plan view of a platform having a system according to the invention, with direct continues loading from the platform to DP operated tankers of which each is provided with a hose-connecting unit on each side of the a midship manifold of the ship.

In the drawings, similar or corresponding parts and elements are designated by equal reference numerals in the different figures.

Figure 1:
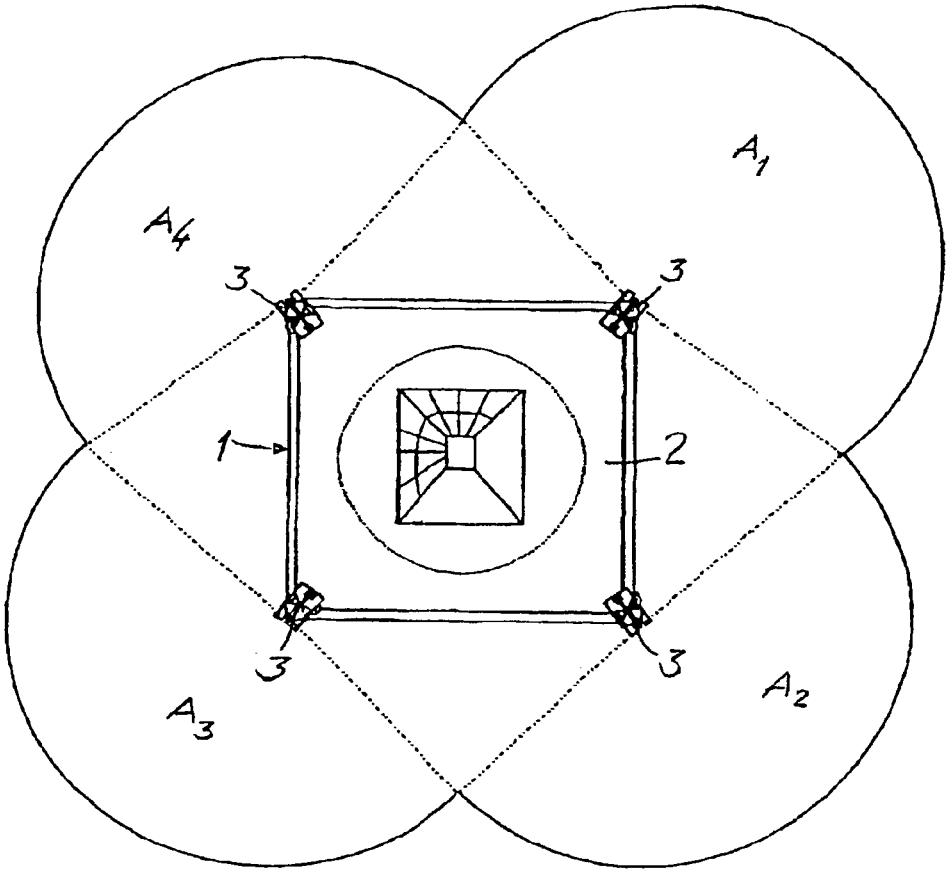

In FIG. 1 there is shown a schematic plan view of a platform 1 having a square platform deck 2 wherein at each comer there is placed a hose handling station 3 forming part of the system according to the invention.

The system further comprises at least one flexible hose 4 (see FIGS. 2 and 3) which is adapted to direct transfer of oil from a supply means on the platform deck to the tanker in question. As further described in connection with FIGS. 9–11, the hose may be repositioned on the platform deck, so that it can be connected to the station 3 having the most favourable location in relation to the prevailing weather direction during a topical transfer operation. When connecting the hose on the four alternative hose handling stations in FIG.1, the hose will cover respective operation areas $A_1$–$A_4$, so that 360 degrees coverage is achieved around the platform.

Figure 2:
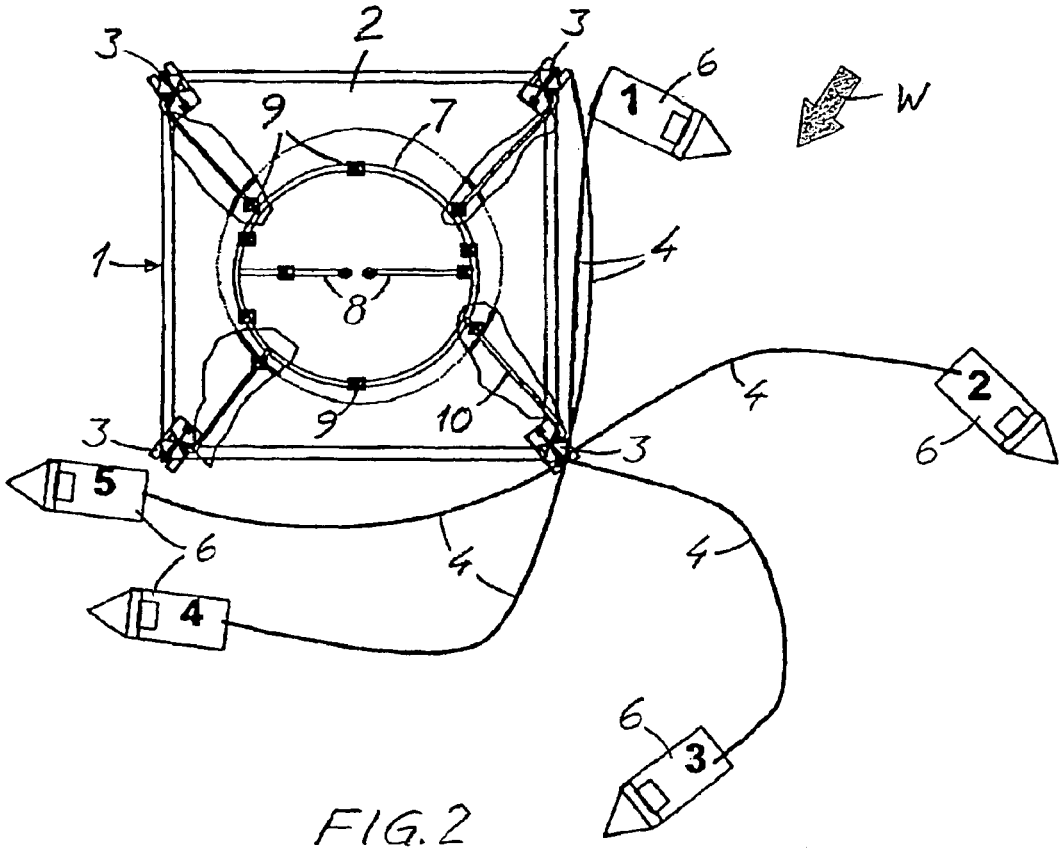
FIG. 2 shows a plan view similar to FIG. 1, wherein a hose is in the process of being repositioned by means of a tender.

In an alternative method for repositioning of the hose 4 there is used a tender 6, as shown in FIG. 2. By this method one end of the hose 4, which has been lowered to the sea surface 5 (FIG. 3), is connected to the tender 6, and this moves the hose in a suitable path which is illustrated by successive positions 1–5 in FIG. 2, so that said hose end is moved around the station where the other hose end is connected, to a position below the closest situated station on the opposite side, where the hose end can be hoisted up and connected on this station. In FIG. 2 the prevailing weather direction is designated by "W".

In FIG. 2 there is also schematically shown an embodiment of a supply arrangement for the supply of oil to the coupling unit on the different hose handling stations 3. As appears, this arrangement comprises a ring line 7 which is connected via radial pipes 8 to the oil storage (not shown) of the platform, and which is provided with is suitable valves 9 for the supply of oil to a desired station 3 via respective pipe sections 10. The arrangement also comprises a water inlet (not shown) for flushing of the oil pipes after use. After flushing the oil pipes will be filled with an inert gas via lines which are coupled directly onto the oil pipes, but which are neither shown.

Figure 3:
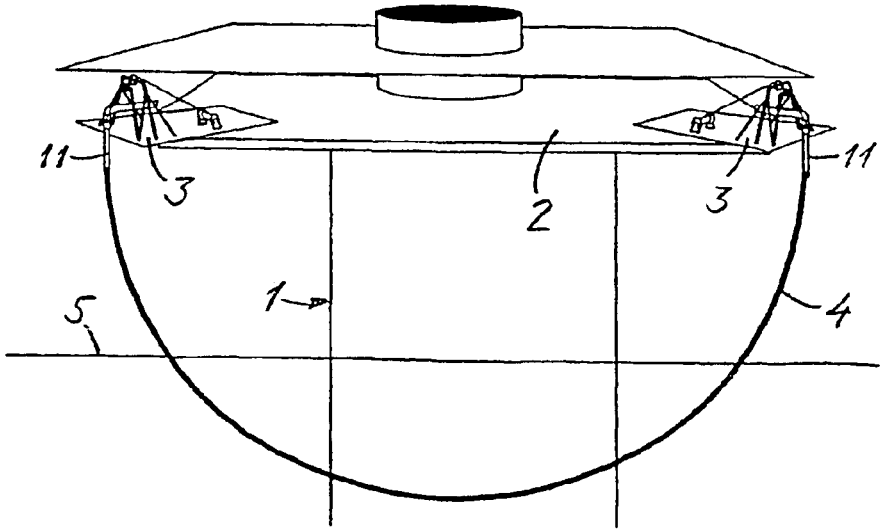
FIG. 3 shows a view of a platform viewed from the side, with a hose hanging in a storage position between two hose handling stations.

When the hose 4 is not in use, it may be suspended in a storage position between two stations 3, as shown in FIG. 3, with the hose ends 11 connected to the coupling unit on the respective station. The hose normally can have a length of 130–150 m, so that the central portion of the hose in the storage position will be situated below the sea surface 5.

In FIG. 3 the hose handling stations 3 are shown to be placed on the cellar deck 2 of the platform.

When it is the question of a platform having a square platform deck where a hose handling station is placed at each corner, as shown in FIG. 1, the system possibly may comprise two hoses. The hoses then suitably will be suspended in a storage position on opposite sides of the platform when they are not in use, with the ends of each hose connected to the coupling unit on the respective station. As will be appreciated, these two hoses will cover all the four operation areas $A_1$–$A_4$ shown in FIG. 1, so that 360 degrees coverage is obtained around the platform, without a repositioning of the hoses. This solution implies, however, the drawback that the hoses will be subjected to detrimental influence, for instance by chafing against the platform or in another manner, when the hoses are on the exposed side with respect to the weather, i.e. the windward side, of the platform.

Figure 4:
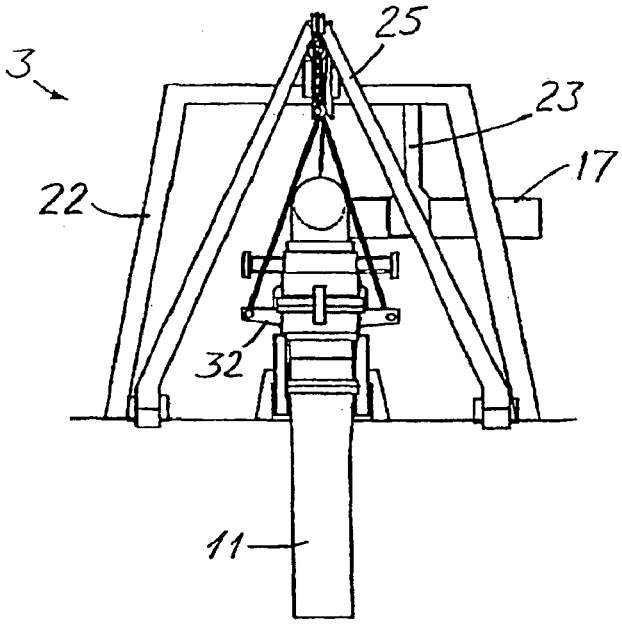
FIGS. 4–6 show a front view, a side view and a plan view, respectively, of a hose handling station.
Figure 5:
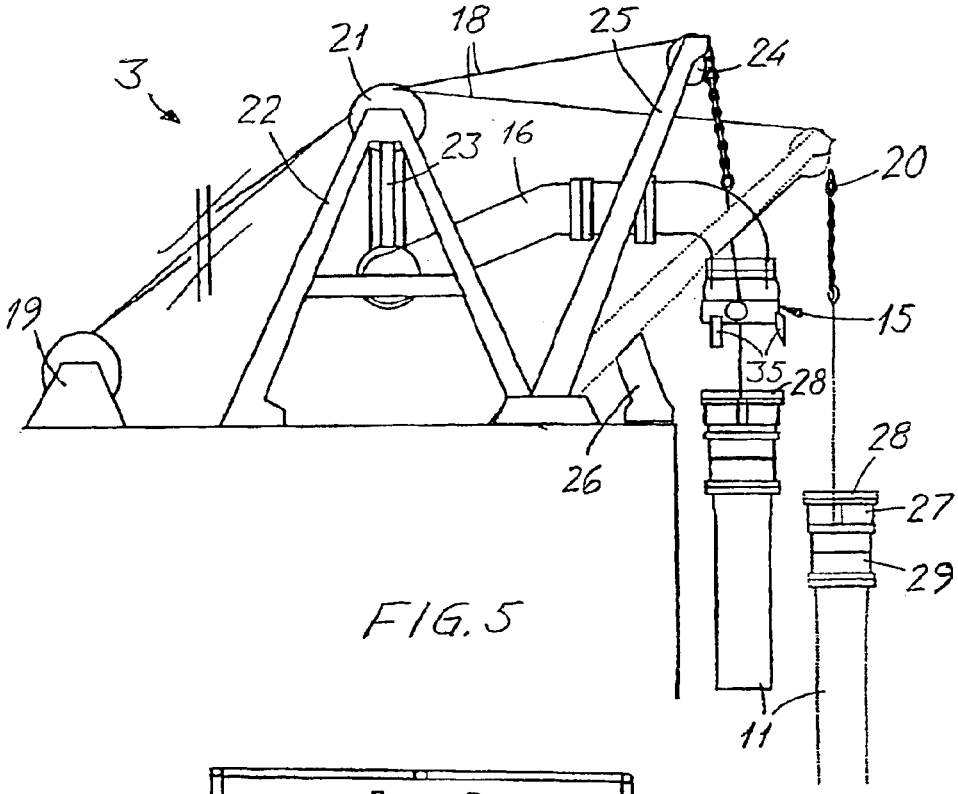
Figure 6:
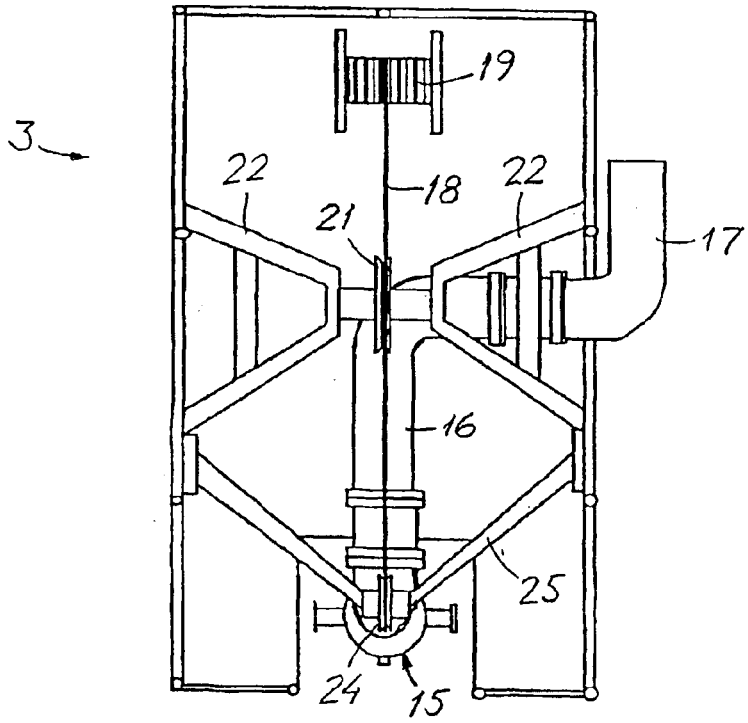

An embodiment of a hose handling station 3 is schematically shown in a front view, a side view and a plan view, respectively, in FIGS. 4–6.

As appears, the hose handling station comprises a coupling unit 15 for connection to one end 11 of a hose 4, the coupling unit communicating via pipe lengths 16, 17 with the aforementioned pipe arrangement 7–10 leading to the oil supply means of the platform. Further, the station comprises a handling means for lowering or hoisting of a hose end 11 to/from the sea surface 5 (FIG. 3), which means comprises a winch-operated wire 18 which is coupled with one end to a winch 19 and with its other end is connected to a remotely releasable hook 20 for connection to the relevant hose end via a lifting bridle means which is to be further described below. The wire 18 is carried over a first, guide pulley 21 mounted on the top of a carrier frame 22. This frame also carries the pipe lengths 16 and 17 via a suspension element 23. The wire 18 further is carried over a second guide pulley 24 mounted at the upper free end of a pivotally mounted lifting frame 25 which is pivotable by connection and disconnection of a hose end 11. A lower pivoting position of the lifting frame 25 is determined by a supporting element 26.

As regards the hose 4 which is used in the present system, this is provided at its ends with similar end terminating units. Each unit comprises a hose valve 27 having a valve flange 28 which is adapted for connection either to the coupling unit 15 on a desired hose handling station or to a loading manifold on the topical tanker. Thereby it is indifferent which end of the hose can be connected at a hose handling station, and which end is delivered to the topical tanker. The hose valve 27 is, connected to the hose via a swivel unit 29.

Figure 8:
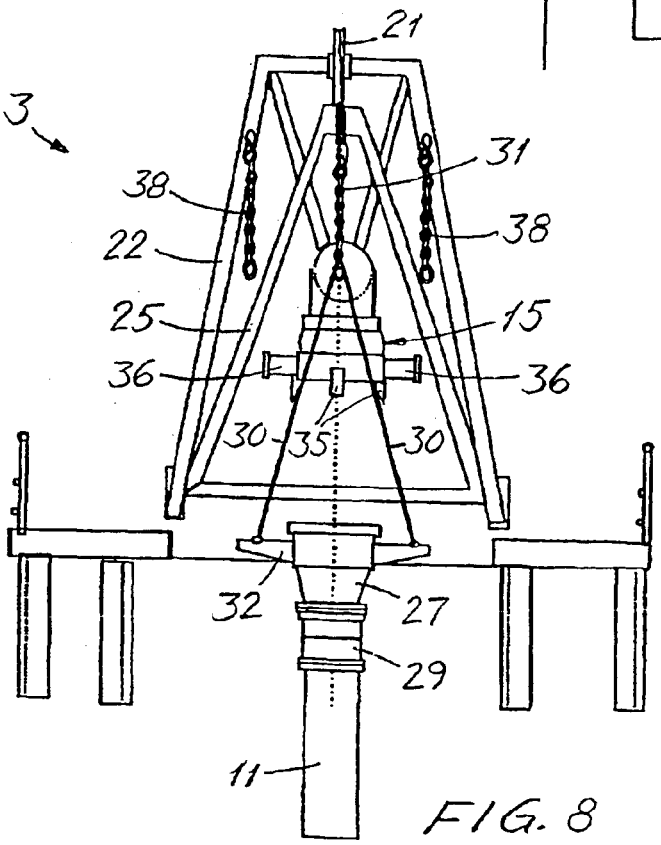

As best shown in FIG. 8, at the end 11 of the hose (i.e. at each hose end) there is arranged a lifting bridle means having a lifting bridle consisting of a pair of lines 30 which, at their upper end, are connected to one end of a so-called wearing chain 31, whereas the other ends of the lines are connected to respective projecting ends of a lifting yoke which is fastened to the hose valve 27. The other end of the wearing chain is intended for connection to the remotely releasable hook 20.

Figure 7:
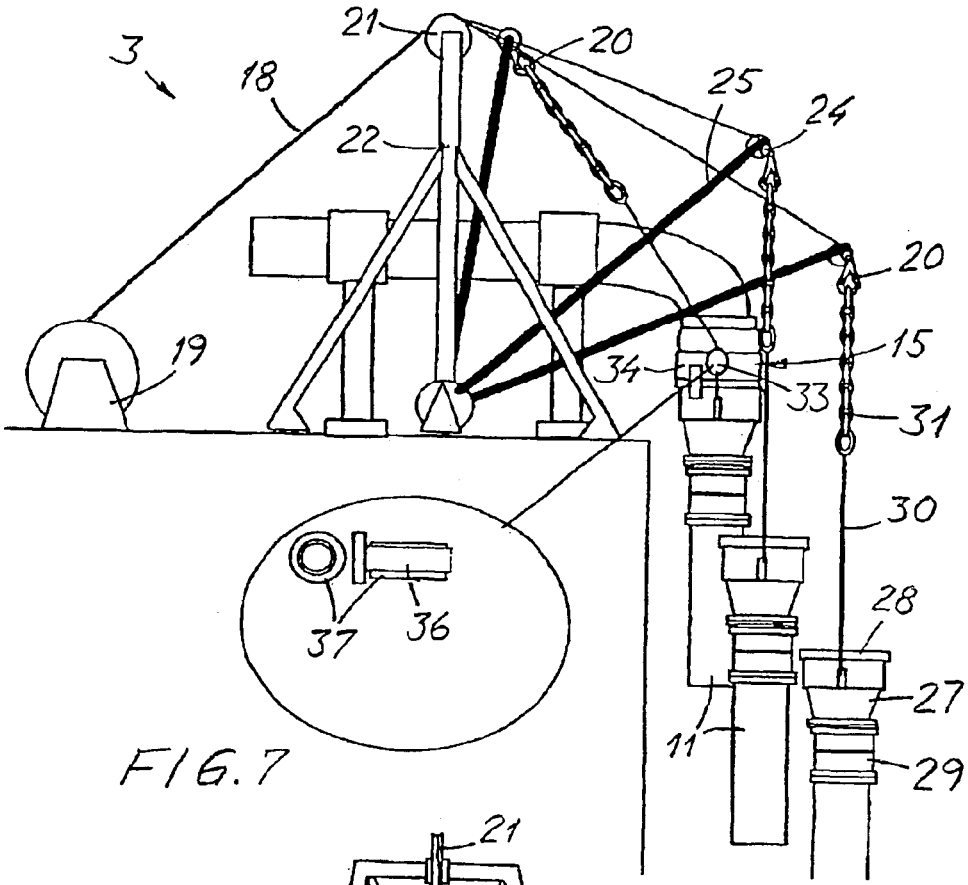
FIGS. 7 and 8 show a side view and a front view, respectively, of a hose handling station and illustrate a connection or disconnection procedure.

The procedure for connection (or disconnection) of a hose end in relation to the coupling unit 15 is illustrated in FIGS. 5 and 7. As regards FIG. 7, this figure shows a hose handling station corresponding to the embodiment of FIG. 5, even if some elements are shown in a somewhat modified design.

As can be seen from FIG. 7, the lifting bridle lines 30 and the wearing chain 31 have a length which is adapted to the length and the variable inclined position of the lifting frame 25, so that the lines, with the pivoting movement of the lifting frame when hoisting and connecting the hose end, are carried over a guide means 33, so that the valve flange 28 of the hose end is automatically interconnected with the coupling unit 15. For this purpose the coupling unit comprises a coupling flange 34 which is provided with a number of guide pins 35 having releasable coupler claws gripping and holding the valve flange 28.

In the illustrated embodiment the guide means 33 consists of a pair of guide horns 36 projecting at opposite sides of the coupling flange 34. On each guide horn there is mounted a rotatable, friction-reducing sleeve 37 which is shown in the enlarged detail in FIG. 7.

In FIG. 8 there are also shown a pair of locking chains 38 which are fastened to the carrier frame 22 and of which the free ends can be releasably connected to the other end of the wearing chain 31 when this is in its upper position in FIG. 7, to prevent thereby an intended disconnection of a hose end when this is connected to the connecting unit 15.

Figure 9:
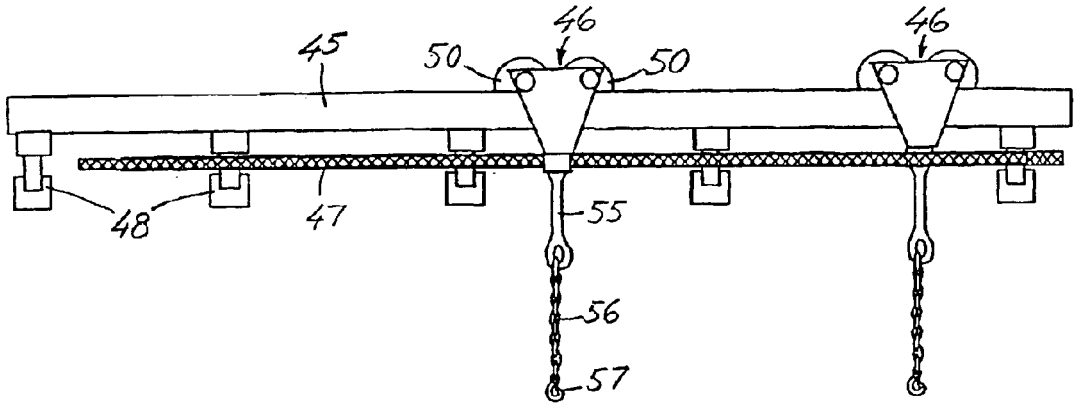
FIG. 9 shows a side view of a segment of an embodiment of a cableway arrangement having pulling carriages for transport and repositioning of a hose.
Figure 10:
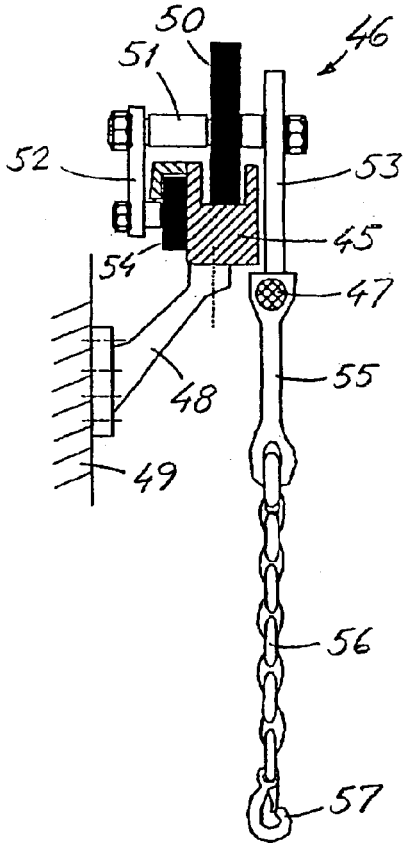
FIG. 10 shows a side view of a pulling carriage according to FIG. 9.
Figure 11:
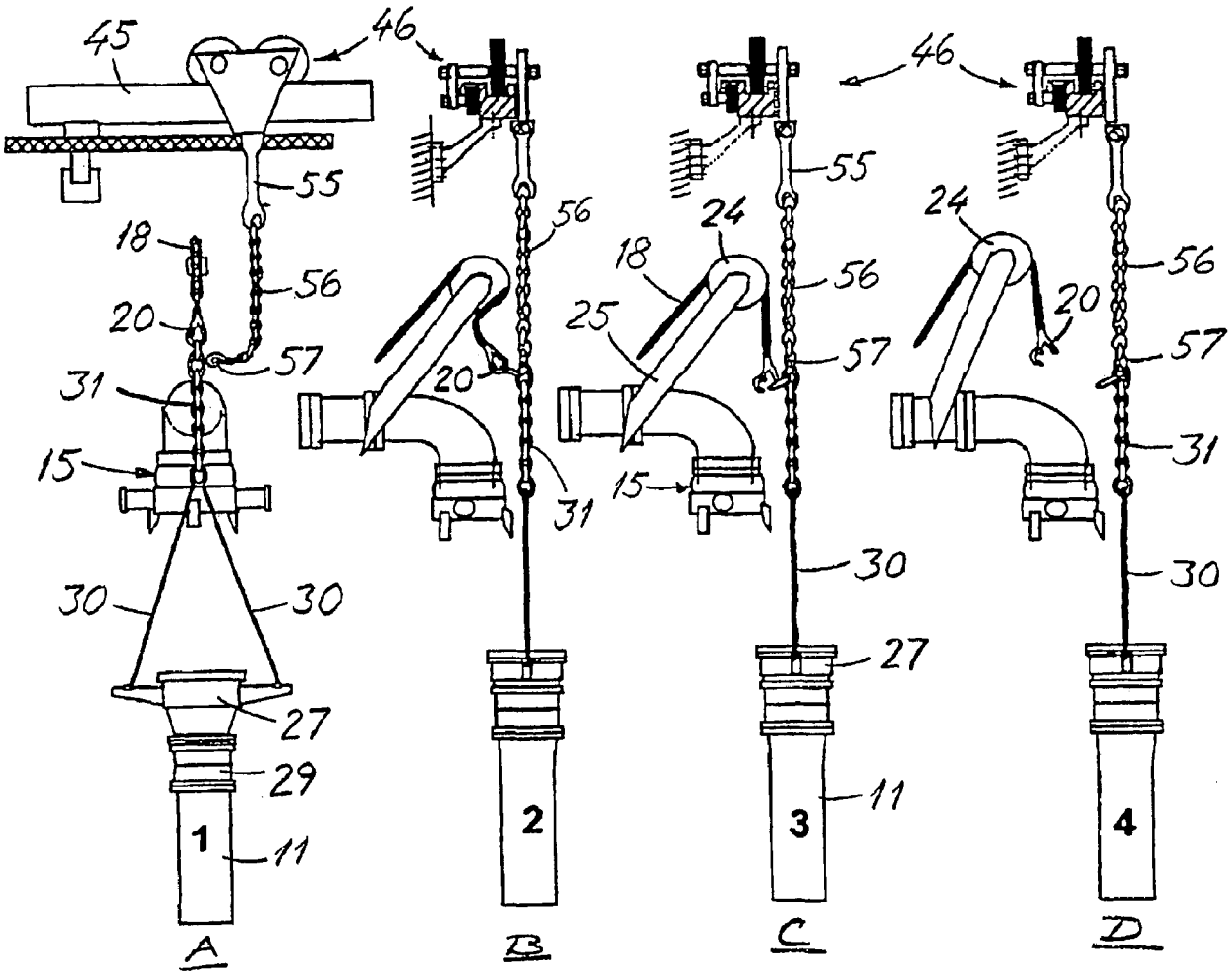

A device for repositioning of the hose at alternative hose handling stations 3 on the platform deck is shown in FIGS. 9 and 10.

In the illustrated embodiment the device comprises a cableway extending along the periphery of the platform deck 2 and which comprises a track body 45 on which there are running a pair of wheeled pulling carriages 46 which are coupled to a pulling cable 47 and are provided with means for connection to respective ends of a hose 4. The track body 45 is supported by a number of carrier brackets 48 which are fastened to a suitable carrier structure 49 (FIG. 10) on the platform.

Each pulling carriage 46 comprises a pair of wheels 50 running in a grove in the track body 45. The wheels are mounted on respective shafts 51 which, at their ends, are mounted in first and second carrier plates 52, 53. In the first carrier plate 52 there is mounted a shaft for a supporting wheel 54 running in an associated, downwards facing supporting grove in the track body 45. A lower part of the second carrier plate 53 is fastened to the pulling cable 47, and further is rigidly connected to a depending cable pulling arm 55. To the lower end of the arm there is fastened a chain 56 having a hook 57 which is intended for connection to the wearing chain 31 which is fastened to the lifting bridle lines 30 of each hose end.

FIGS. 11A–D illustrate different steps 1–4 in the transfer of a hose end 11 from a hose handling station and connection of the hose end to the cable pulling arm on a pulling carriage 46.

In FIG. 11A the hose 4 hangs in a position largely corresponding to the centre position shown in FIG. 7. In this position the hook 57 is connected to a link in the chain 31 below the uppermost link to which the book 20 at the end of the wire 18 is fastened. Thereafter the hose 4 is lowered by means of the winch 19 to the position shown in FIG. 11B where the hose hangs with its entire weight in the chain 56 below the carriage 46. The hook 20 then can be loosened from the chain 31, as shown in FIG. 11C. Thereafter the lifting frame 25 is raised, so that the hook 20 is removed from the chains 31 and 56, as shown in FIG. 11D, and the end in question of the hose then is ready to be transported to the desired hose handling station.

A procedure for lowering of a hose from a hose handling station, and for transferring the hose end to a tanker, will be described below with reference to FIG. 12. This figure shows a view of a hose handling station 3 on a platform deck 2, a tender 6 and a tanker 58. As mentioned above, the tanker is presupposed to be equipped with a dynamic positioning system (DP system), and further the tanker in this case is equipped with a bow loading system suggested at 59 in the figure.

The figure shows a situation wherein a hose 4 is in the process of being lowered from the hose handling station, and wherein a forerunner line 60 is connected to the lifting bridle means of the hose, which line has been taken onboard the tender 6. The forerunner line 60 is fastened to the wearing chain 31, as shown in FIG. 13 which shows the detail A in FIG. 12 on an enlarged scale. As will be seen, the other end of the hose 4 will be connected at the station on the platform deck 2 from which oil is to be transferred to the tanker.

In the further lowering of the hose 4 the tender positions itself so that the. forerunner 60 is stretched as the hose is laid down in the sea. When the hose valve 27 lies in the water and the forerunner is taught, the remote release hook 20 is released from the platform. The tender now holds the entire weight of the hose 4 and the hose valve 27.

On the tender the forerunner 60 is connected to a messenger line and a pick-up line, and the tender positions itself for transferring the pick-up line to the tanker which is now in DP mode. The pick-up line is shot over to the tanker by means of an airgun. On the tanker the pick-up line, is placed on a pulling winch, and the pick-up line and the messenger line are hauled in by means of the winch. On the tender the messenger line is dropped overboard in a controlled manner as the line is hauled onboard the tanker.

On the tanker 58 the forerunner line is hauled in until the hose valve 27 is located below the relevant coupler valve in the bow loading system 59. Thereafter the hose valve is hoisted up and connected to the coupler valve. By means of telemetry signals a communication connection is established between the tanker and the platform, and a signal that the unloading operation may start, is transferred to the platform. A separate "oil channel" for verbal communication between the unloading control room of the platform and the loading control room of the tanker is maintained during the whole loading operation.

When the loading is completed, the tanker 58 lowers the hose 4 carefully down while the ship slides slowly aftward.

Two small buoys are connected to the pick-up line, and the forerunner, the messenger line and the pick-up line with buoys are dropped into the sea. The tender picks up the pick-up line and hauls in the messenger line on a separate winch. When the forerunner has been pulled in onto the deck of the tender, this is made fast, and the messenger line and the pick-up line are released.

The tender thereafter goes into position below the relevant hose handling station, whereafter the hose valve 27 is pulled up, so that the remote release hook 20 can be coupled directly to the wearing chain 31 in which the lifting bridle hangs. The remote release hook 20 is lowered from the hose handling station, so that the crew on the tender gets hold of it, possibly by means of a guide line depending from the hook. The hook thereafter is coupled to the wearing chain, and the forerunner 60 is lowered at the same time as the tender moves slowly away from the platform. At the same time the hose is hoisted up to the platform, and the hose end is connected as described below.

The lifting bridle means with the hose is hoisted up to a position in which the upper end of the wearing chain 31 stops against the guide pulley 24 of the lifting frame 25. Further hauling of the lifting wire 18 will raise the lifting frame 25 upwards and backwards, so that the lifting bridle lines 30 come into abutment against the guide horn 36 of the coupling unit 15. This entails that the hose valve 27 will be hanging vertically under the coupling unit 15. By further hoisting the hose valve flange 28 is centred by the guide pins 35 on the coupling flange 34. Said flanges are brought into abutment against each other, and the coupler claws of the guide pins lock the flanges to each other. After the coupler claws of the guide pins are activated, the coupling is locked hydraulically. In order to prevent uncontrolled lowering or an unwanted disconnection, the system is locked manually with the locking chains 38 which are fastened to the lower chain link of the wearing chain.

In the transfer of oil from a platform to a tanker which is equipped with a bow loading system, as mentioned in connection with FIG. 12, the bow of the tanker will point towards the platform when the tanker loads oil from the most favourably located hose handling station on the platform with respect to the weather. This corresponds to the situation of the introductorily mentioned, known loading systems where there are also used DP operated tankers which in a loading situation turn with the weather, according to the weathervane principle.

The principle implies that the tanker, in case of a possible total loss of machine power and electric current, will drift away from the platform without causing damage on itself or on the platform.

Experience in connection with the known systems has, however, shown that, because of failure of the DP system or in some cases human failure, an acute uncontrolled forward movement of the tanker has arisen, with the result that this has touched the production unit/loading tower, before one has been able to restore the control. This is a most unwanted situation which one tries to avoid to the highest possible extent.

In connection with the present system it is essential to limit and preferably eliminate the risk of collision between platform and tanker. To this end as great distance between ship and platform as practically possible is aimed at, and also a high degree of redundance in the positioning and manoeuvring systems of the ships.

An advantageous loading configuration, which results in a reduced risk of contact with the platform in case of a possible loss of machine power and/or control of the tanker, is shown in FIG. 14. In this embodiment the illustrated tanker 61 is equipped with a loading system having a midship manifold 62 and with a hose handling and connecting system 63.

When the tanker 61 lies in "weathervane mode", as presupposed in FIG. 14, the midship area will be the most favourable with respect to movement for both hose and hose coupling. A hose coupling of the so-called "free moment" type will additionally stabilize the movements of the hose.

With the hose 4 connected midship and the tanker 61 connected to the most favourable hose handling station on the platform with respect to the weather, as shown in FIG. 14, the bow of the ship will never point towards the platform 1. The tanker, which is DP operated, will be able to maintain the current position even if the weather turns 90°, without having to change hose handling station.

The distance between the ship and the platform will be maintained at a relatively "comfortable" level, with regard to operational security. A typical distance will be between 80 and 120 m.

An additional advantageous loading configuration is shown in FIG. 15. By means of this configuration one can carry out continuous loading from a production platform is which is without an oil storage. Within the oil branch this principle is referred to as "direct shuttle loading". As will be seen, this loading possibility is achieved in that a hose handling and connecting system 63 is arranged on each side of the midship manifolds 62.

In this loading configuration the tankers succeed each other in that the next ship is connected via an additional hose 4 to the hose handling station 3 which is located opposite to the station to which the first tanker is connected. The next tanker is connected before the first ship is disconnected, so that the oil flow is maintained and can be directed to the next ship before the first one is disconnected.

Two different manners may be used for transferring the hose to the relevant tanker. One is carried out by means of a tender as described above. The other consists in direct transfer of the hose to the tanker.

With the latter method the tanker positions itself approximately 100 m from the relevant hose handling station on the platform, and the pick-up line is shot over from the platform to the ship. By means of a separate winch the tanker will then pull the line and the hose forerunner over to the hose connecting unit arranged midship.

The latter method requires that each hose handling station on the platform is equipped with pulling winches for suitable lines, e.g. fibre lines, and with a storage unit for these lines.

What is claimed is:

1. A system for transferring oil from an offshore tanker to a platform, wherein it comprises at least one flexible hose (4) which is adapted to direct transfer of hydrocarbons from a supply means (7–10) on a deck (2) on the platform (1) to the tanker (58) in question, and a number of hose handling stations (3) which are distributed around the circumference of the platform deck (2), each station (3) being provided with a coupling unit (15) which communicates with the supply means (7–10) and is arranged for connection or disconnection of an end (11) of the hose (4), and a handling means (18–22, 24, 25) for lowering or hoisting of the hose end (11) to/from the surface (5) of the water around the platform (1).

2. A system according to claim 1, for use on a platform (1) having a square platform deck (2), wherein it comprises four hose handling stations (3) which are placed in respective corners of the platform deck (2).

3. A system according to claim 2, wherein it comprises two hoses (4), the hoses being arranged to be suspended in a storage position on opposite sides of the platform (1) when they are not in use, with the ends (11) of each hose connected to a coupling unit (15) on a respective hose handling station (3).

4. A system according to claim 1, wherein it comprises a transfer device (45–47) for the transfer and repositioning of the hose (4) on alternative hose handling stations (3) on the platform deck (2).

5. A system according to claim 4, wherein the transfer device comprises a cableway extending along the periphery of the platform deck (2), and which comprises a pair of pulling carriages (46) running on a track body (45) and being coupled to a pulling cable (47), the carriages (46) being provided with a connecting means (55–57) for connection to a respective hose end (11).

6. A system according to claim 1, wherein the hose (4) at its ends (11) is provided with similar end terminating units (27–29), each unit comprising a hose valve (27) having a valve flange (28) which is adapted for connection either to the coupling unit (15) on a desired hose handling station (3) or to the loading manifold on the relevant tanker (58; 61).

7. A system according to claim 1, wherein the handling means comprises a winch-operated wire (18) which at its free end is connected to a remotely releasable hook (20) for connection to the relevant hose end (11).

8. A system according to claim 6, wherein, at each hose end (11), there is arranged a lifting bridle comprising two lines (30) which, when hoisting a hose (4) by means of said wire (18), are arranged to be carried over a guide means (33), so that the valve flange (28) of the hose end (11) is automatically interconnected with the coupling unit (15) on the relevant hose handling station (3).

9. A system according to claim 6, wherein the hose valve (27) is coupled to the hose end (11) via a swivel unit (29), and that the lines (30) of the lifting bridle are connected to respective ends of a lifting yoke (32) which is connected to the swivel unit (29).

10. A system according to claim 7, wherein the wire (18) is carried over a guide pulley (25) which is mounted at an upper end of a pivotally mounted lifting frame (25) which is limitedly pivotable when connecting and disconnecting a hose end (11).

11. A system according to claim 7, wherein at each hose end (11), there is arranged a lifting bridle comprising two lines (30) which, when hoisting a hose (4) by means of said wire (18), are arranged to be carried over a guide means (33), so that the valve flange (28) of the hose end (11) is automatically interconnected with the coupling unit (15) on the relevant hose handling station (3).

12. A system according to claim 8, wherein the hose valve (27) is coupled to the hose end (11) via a swivel unit (29), and that the lines (30) of the lifting bridle are connected to respective ends of a lifting yoke (32) which is connected to the swivel unit (29).

* * * * *